US012503832B2

(12) United States Patent
DeWind et al.

(10) Patent No.: US 12,503,832 B2
(45) Date of Patent: Dec. 23, 2025

(54) DRIVE POD SYSTEM FOR AN EXCAVATOR

(71) Applicant: One Pass Innovators, LLC, Zeeland, MI (US)

(72) Inventors: Ryan DeWind, Zeeland, MI (US); Gregory Allen DeWind, Zeeland, MI (US)

(73) Assignee: One Pass Innovators, LLC, Zeeland, MI (US)

( * ) Notice: Subject to any disclaimer, the term of this patent is extended or adjusted under 35 U.S.C. 154(b) by 1007 days.

(21) Appl. No.: 17/558,544

(22) Filed: Dec. 21, 2021

(65) Prior Publication Data

US 2022/0195696 A1 Jun. 23, 2022

Related U.S. Application Data

(60) Provisional application No. 63/128,653, filed on Dec. 21, 2020.

(51) Int. Cl.

| | |
|---|---|
| ***E02F 5/14*** | (2006.01) |
| ***E02F 3/14*** | (2006.01) |
| ***E02F 9/20*** | (2006.01) |

(52) U.S. Cl.

CPC ..... *E02F 9/20* (2013.01); *E02F 3/145* (2013.01); *E02F 5/14* (2013.01)

(58) Field of Classification Search

CPC ..... E02F 3/04; E02F 3/246; E02F 3/65; E02F 3/145; E02F 5/02; E02F 5/14; E02F 9/0866; E02F 9/123; E02F 9/20

See application file for complete search history.

(56) References Cited

U.S. PATENT DOCUMENTS 5,315,770 A * 5/1994 Campbell ..... E02F 3/188 37/190
5,664,347 A * 9/1997 Chapman, Sr. ..... E02F 3/145 37/360

FOREIGN PATENT DOCUMENTS

CN 106978830 B * 11/2018 ..... B66D 1/12
GB 2337965 A * 12/1999 ..... B62D 21/186
WO WO-9305974 A1 * 4/1993 ..... B60K 17/342

OTHER PUBLICATIONS

Dewind, One Pass Trencher, https://www.youtube.com/watch?v=B3a65Ustvf4&t=4s, 2019.*

* cited by examiner

*Primary Examiner* — Adam J Behrens
(74) *Attorney, Agent, or Firm* — The Watson IP Group; Jovan N. Jovanovic

(57) ABSTRACT

A drive pod system for an excavator includes a first drive pod, a second drive pod, and a central gearbox. The first drive pod includes a first drive mechanism and a first drive pod frame, the first drive mechanism coupled to the first drive pod frame. The second drive pod includes a second drive mechanism and a second drive pod frame, the second drive mechanism coupled to the second drive pod frame. The central gearbox receives power produced by the first drive mechanism and the second drive mechanism and transfers the power to a ground manipulator apparatus of the excavator. The first and second drive pod frames are coupled to an excavator frame of the excavator.

17 Claims, 9 Drawing Sheets

DRIVE POD SYSTEM FOR AN EXCAVATOR

CROSS-REFERENCE TO RELATED APPLICATION

This application claims priority from U.S. Provisional Patent Application Ser. No. 63/128,653 filed on Dec. 21, 2020, entitled "DRIVE POD SYSTEM FOR AN EXCAVATOR", the entire disclosure of which is hereby incorporated by reference in its entirety.

BACKGROUND OF THE DISCLOSURE

1. Field of the Disclosure

The disclosure relates in general to a drive system, and more particularly, to a drive pod system.

2. Background Art

Ground excavation is used for a variety of purposes. For example, ground excavation can be used for mining, demolition, grading, landscaping, digging of trenches, holes, and foundations, etc. To perform such ground excavation, extremely large machinery is used to typically move large quantities of ground material, such as dirt and stone. This machinery includes crawler excavators, wheeled excavators, section excavators, long reach excavators, hydraulic shovels, dragline excavators, skid steers, trenchers, along with other types of excavators.

For such machinery to operate, extremely large engines or motors are typically used to drive such machinery, these engines or motors typically producing hundreds of horsepower. This high horsepower is needed to move large quantities of ground material, typically tens of thousands of pounds of ground material. For performance of ground excavation, as opposed to other functions such as mobility, such machinery typically employs a single such engine or motor.

SUMMARY OF THE DISCLOSURE

The disclosure is directed to a drive pod system for an excavator, with the drive pod system comprising a first drive pod, a second drive pod, and a central gearbox. The first drive pod includes a first drive mechanism and a first drive pod frame, the first drive mechanism coupled to the first drive pod frame. The second drive pod includes a second drive mechanism and a second drive pod frame, the second drive mechanism coupled to the second drive pod frame. The central gearbox receives power produced by the first drive mechanism and the second drive mechanism and transfers the power to a ground manipulator apparatus of the excavator. The first and second drive pod frames are coupled to an excavator frame of the excavator.

In some configurations, the first and second drive mechanisms are at least one of both engines, both motors, and a combination of an engine and a motor.

In some configurations, the first and second drive pods further include a first radiator and a second radiator to cool the first and second drive mechanisms, respectively.

In some configurations, the drive pod system further includes a first radiator guard and a second radiator guard disposed proximate to the first radiator and the second radiator, respectively, to guard the first radiator and the second radiator.

In some configurations, the first drive pod further includes a first transmission and the second drive pod further includes a second transmission, the first and second transmissions being coupled to drive shafts of the first and second drive mechanisms to the central gearbox, respectively.

In some configurations, the first and second transmissions are 8000 series transmissions by Allison Transmission.

In some configurations, the excavator is a trencher.

In some configurations, the first and second engines are each a Caterpillar C32 engine.

In some configurations, the excavator further comprises a fuel tank disposed a proximate distance from the first and second drive pods.

In some configurations, the central gearbox includes a first gear coupled to the first drive mechanism and a second gear coupled to the second drive mechanism, and a chain that couples the first gear and the second gear to the ground manipulator apparatus wherein the first and second drive mechanisms drive the first and second gears, respectively, to transfer power from the first and second drive mechanisms to the central gearbox.

In some configurations, each of the first and second drive pod frames include a grate disposed over the first and second drive mechanism, respectively.

In some configurations, the first and second drive pods are disposed on a same side of the central gearbox.

In some configurations, the first and second drive pods each further include a transmission and a transmission cooler to reduce a temperature of a transmission during use of the excavator.

In some configurations, the first and second drive pods each further include an intake cooler to reduce a temperature of air entering the first and second drive mechanisms.

In some configurations, the first and second drive pods further each include a battery coupled to the first and second drive mechanisms, respectively.

BRIEF DESCRIPTION OF THE DRAWINGS

The disclosure will now be described with reference to the drawings wherein.

DETAILED DESCRIPTION OF THE DISCLOSURE

Figure 1A:
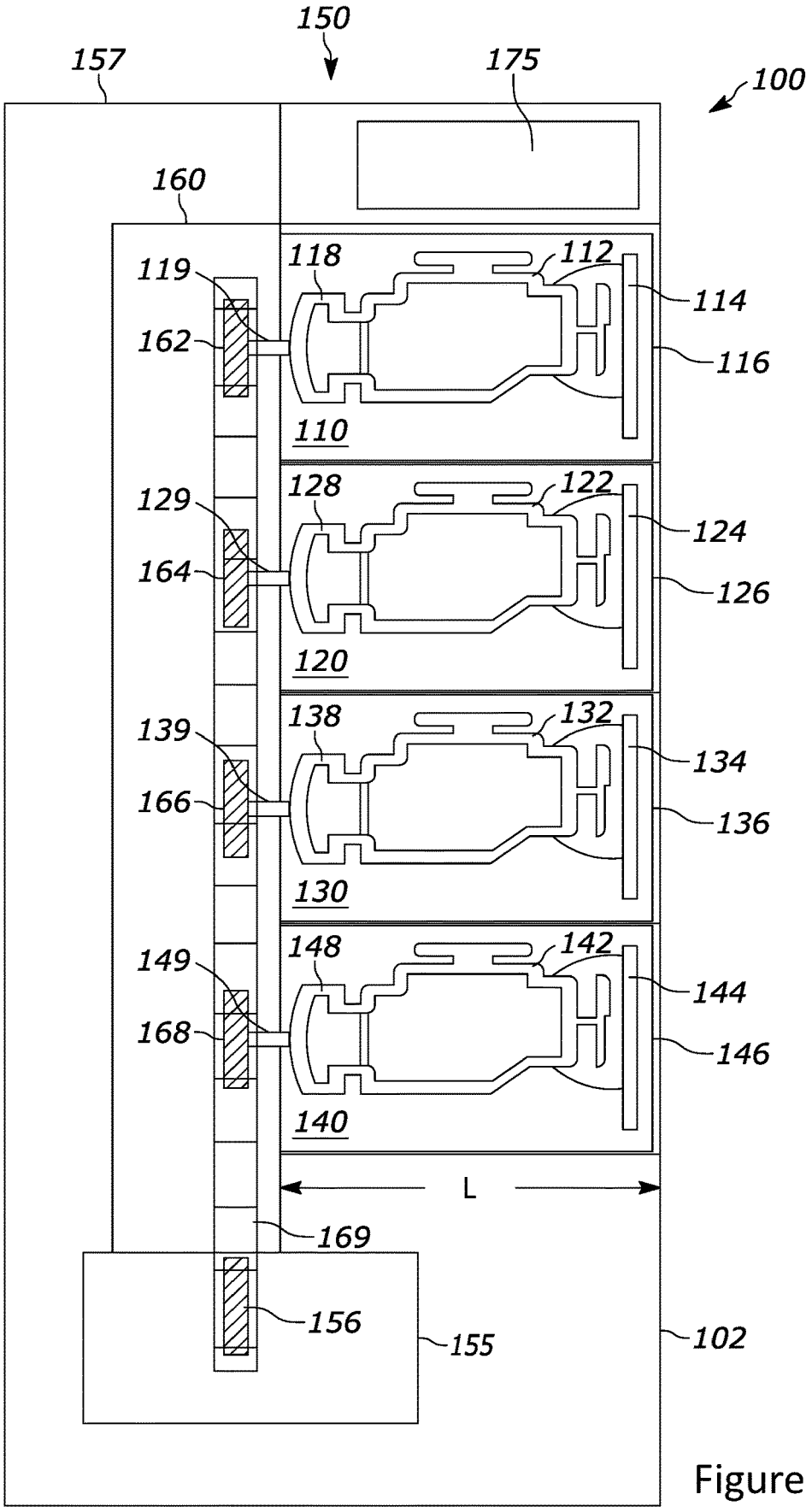
FIG. 1A illustrates an example drive pod system, in accordance with at least one configuration disclosed herein.

While this disclosure is susceptible of configuration(s) in many different forms, there is shown in the drawings and described herein in detail a specific configuration(s) with the understanding that the present disclosure is to be considered as an exemplification and is not intended to be limited to the configuration(s) illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1A, a system is disclosed, such as a drive pod system 100. The drive pod system 100 includes a plurality of drive mechanisms, such as a plurality of engines, in at least one configuration. The drive pod system 100 includes a first drive pod 110, a second drive pod 120, a third drive pod 130, and a fourth drive pod 140. As shown, the first drive pod 110, the second drive pod 120, the third drive pod 130, and the fourth drive pod 140 are disposed next to each other, such that they are disposed along a same side of a central gearbox 160 that each of the first drive pod 110, the second drive pod 120, the third drive pod 130, and the fourth drive pod 140 are coupled to. In other configurations, at least one of the first, second, third, and fourth drive pods 110, 120, 130, and 140 can be disposed on opposite sides of the central gearbox 160 from other of the drive pods, such as in an alternating pattern on different sides of the central gearbox 160. In at least one configuration, the first, second, third, and fourth drive pods 110, 120, 130, and 140 can be configured in length L such that the first, second, third, and fourth drive pods 110, 120, 130, and 140 align with a side 102 of an excavator 150 (e.g., crawler excavators, wheeled excavators, section excavators, long reach excavators, hydraulic shovels, dragline excavators, skid steers, trenchers, or another other type of excavator), as shown. Although four drive pods are shown, the drive pod system 100 can include two, three, or more than four drive pods, without departing from the scope of the configurations.

Figure 7:
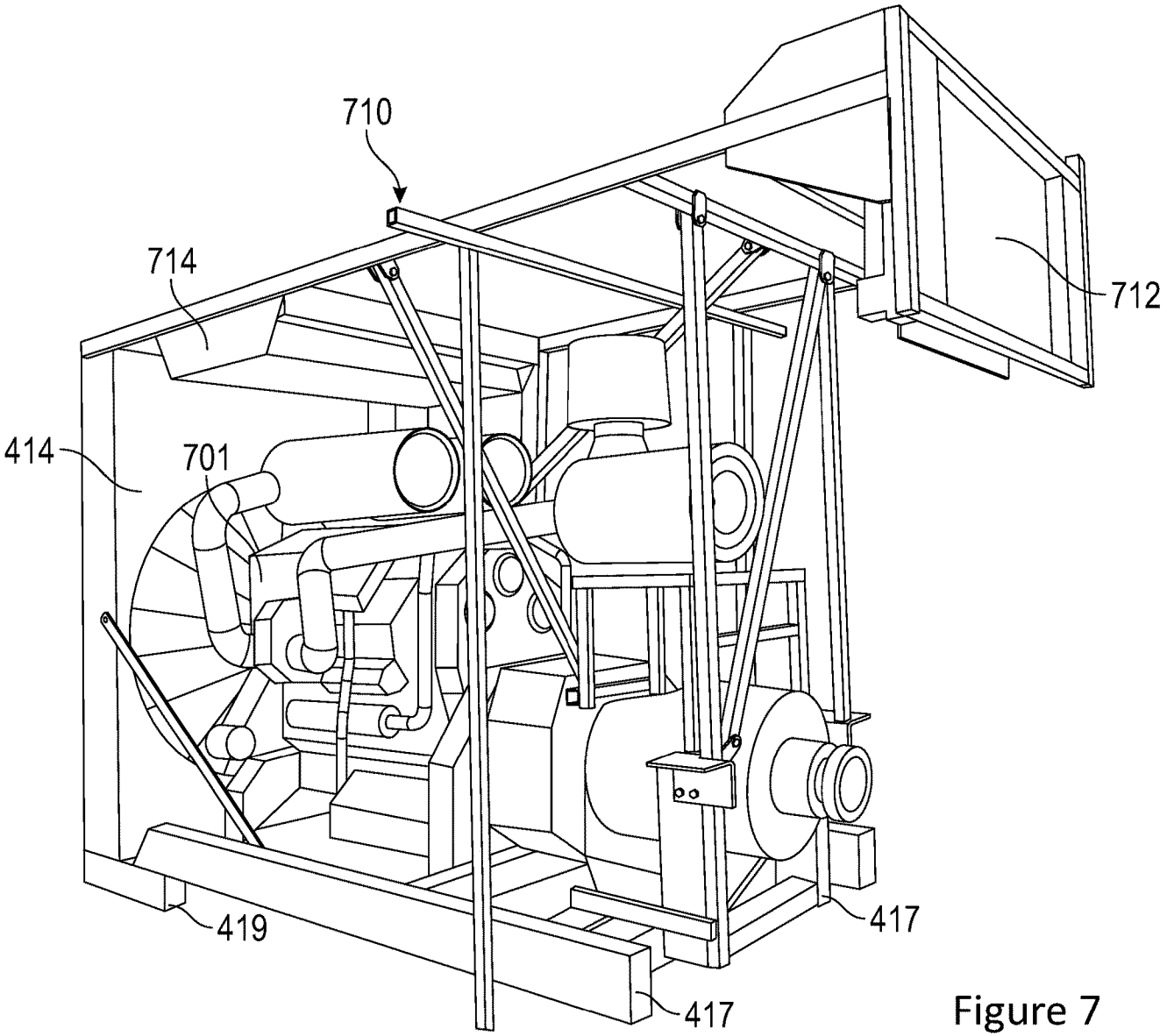
FIG. 7 illustrates an isometric view of another example single drive pod, in accordance with at least one configuration disclosed herein.

Each of the first, second, third, and fourth drive pods 110, 120, 130, and 140 include a drive mechanism, such as an engine, a radiator, and a drive pod frame. For example, the first drive pod 110 includes a first engine 112, the second drive pod 120 includes a second engine 122, the third drive pod 130 includes a third engine 132, and the fourth drive pod 140 includes a fourth engine 142, the first, second, third, and fourth engines 112, 122, 132, and 142 used to power the excavator 150 to which they are coupled (e.g., bolted). Typically, when an excavator needs more power for excavation a larger engine is used, which substantially increases a cost associated with the excavator. The use of multiple engines, as disclosed herein, allows for use of smaller and less costly engines, which also has additional benefits discussed below. Likewise, the first drive pod 110 includes a first radiator 114, the second drive pod 120 includes a second radiator 124, the third drive pod 130 includes a third radiator 134, and the fourth drive pod 140 includes a fourth radiator 144, to cool the first, second, third, and fourth engines 112, 122, 132, and 142, respectively. In at least one configuration, a drive pod 710 (FIG. 7) can further include a transmission cooler 712 to reduce a temperature of a transmission 718 and/or an intake cooler 714 to reduce a temperate of air entering the engine 701, during use of the drive pod 710.

Each of the first, second, third, and fourth drive pods 110, 120, 130, and 140 also include a drive pod frame. For example, the first drive pod 110 includes a first drive pod frame 116, the second drive pod 120 includes a second drive pod frame 126, the third drive pod 130 includes a third drive pod frame 136, and the fourth drive pod 140 includes a fourth drive pod frame 146. The first, second, third, and fourth drive pod frames 116, 126, 136, and 146 can be constructed from steel, aluminum, or any other material that has strength to support the components attached thereto, such as the first, second, third, and fourth engines 112, 122, 132, and 142. The first, second, third, and fourth engines 112, 122, 132, and 142 and the first, second, third, and fourth radiators 114, 124, 134, and 144 are coupled (e.g., bolted) to the first, second, third, and fourth drive pod frames 116, 126, 136, and 146, respectively, such that the first, second, third, and fourth drive pods 110, 120, 130, and 140 can be individually removed from the excavator 150 should either the excavator 150 need more or less power for a particular excavation and/or at least one of the first, second, third, and fourth engines 112, 122, 132, and 142 breaks and needs repaired.

Should any of the first, second, third, and fourth engines 112, 122, 132, and 142 break, instead of having to temporarily shut down a worksite to fix the broken engine, the entire drive pod can be removed and replaced with a new drive pod that includes a working engine. This is especially beneficial in that the broken engine (or any broken components associated with the engine, such as a radiator) from any of the first, second, third, and fourth drive pods 110, 120, 130, and 140 can be fixed while work continues on the worksite with a replaced engine. Additionally, as gross weight of a vehicle traveling on the interstate road system of the U.S. is Federally limited to 80,000 pounds, the ability to remove drive pods from the excavator 150 for transport provides a benefit of not having to transport an excavator weighing over 80,000 via another type of transport, such as rail which is more costly than interstate road system. Thus, the drive pod systems 100 and 101 disclosed herein provide for a more cost-effective solution to transporting the excavator 150.

The excavator 150 includes a ground manipulator apparatus 155 and an excavator frame 157. The first, second, third, and fourth drive pod frames 116, 126, 136, and 146 are securely coupled (e.g., bolted) to the excavator frame 157 such that first, second, third, and fourth drive pod frames 116, 126, 136, and 146 do not move when the first, second, third, and fourth engines 112, 122, 132, and 142 are driving the ground manipulator apparatus 155. The first, second, third, and fourth drive pod frames 116, 126, 136, and 146 can be hoisted from a top thereof into position onto the excavator frame 157, such as via a crane (not shown) or another excavator (not shown). The ground manipulator apparatus 155 can be any of shovel, an auger, a breaker, a thumb, a pipe, a trencher, or any other type of ground manipulator apparatus 155 depending upon the type of excavator 150 needed for a particular worksite.

The central gearbox 160 receives power produced by the first, second, third, and fourth engines 112, 122, 132, and 142 and transfers that power to the ground manipulator apparatus 155. As shown, the central gearbox 160 is disposed along an opposite side of the excavator frame 157 from which the first, second, third, and fourth drive pods 110, 120, 130, and 140 are disposed. In at least one configuration, the central gearbox 160 includes gears and a chain 169 that transfer the power produced by the first, second, third, and fourth engines 112, 122, 132, and 142 to the ground manipulator apparatus 155, such a first gear 162 coupled to the first engine 112, a second gear 164 coupled to the second engine 122, a third gear 166 coupled to the third engine 132, and a fourth gear 168 coupled to the fourth engine 142. Thus, the first, second, third, and fourth engines 112, 122, 132, and 142 drive the first, second, third, and fourth gears 162, 164, 166, and 168, respectively, to transfer power from the first, second, third, and fourth engines 112, 122, 132, and 142 to the central gearbox 160. The chain 169 can drive another gear, such as a fifth gear 156 coupled to the ground manipulator apparatus 155, as shown.

In at least one configuration, the first, second, third, and fourth drive pods 110, 120, 130, and 140 further include first, second, third, and fourth transmissions 118, 128, 138, and 148, although the drive pod system 100 can operate without such transmissions. In some configurations, the first, second, third, and fourth transmissions 118, 128, 138, and 148 are 8000 series transmissions by Allison Transmission. The first, second, third, and fourth transmissions 118, 128, 138, and 148 can use a reduction gearset (not shown) to increase a torque produced by the first, second, third, and fourth engines 112, 122, 132, and 142. During installation of the first, second, third, and fourth drive pods 110, 120, 130, and 140, a first, second, third, and fourth drive shaft 119, 129, 139, and 149 (e.g., spline shafts) protruding from the first, second, third, and fourth drive pods 110, 120, 130, and 140, respectively, such as from either the first, second, third, and fourth engines 112, 122, 132, and 142 or, if so configured, from the first, second, third, and fourth transmissions 118, 128, 138, and 148, are slid into the first, second, third, and fourth gears 162, 164, 166, and 168, respectively.

In at least one configuration, the excavator 150 can further include a fuel tank 175 coupled to the first, second, third, and fourth engines 112, 122, 132, and 142, the fuel tank 175 being disposed a proximate distance from the first, second, third, and fourth drive pods 110, 120, 130, and 140, as shown. In an alternate configuration not shown, each of the first, second, third, and fourth drive pods 110, 120, 130, and 140 can include first, second, third, and fourth fuel tanks, respectively, such that these respective fuel tanks can be removed from the excavator 150 along with the first, second, third, and fourth drive pods 110, 120, 130, and 140.

Figure 1B:
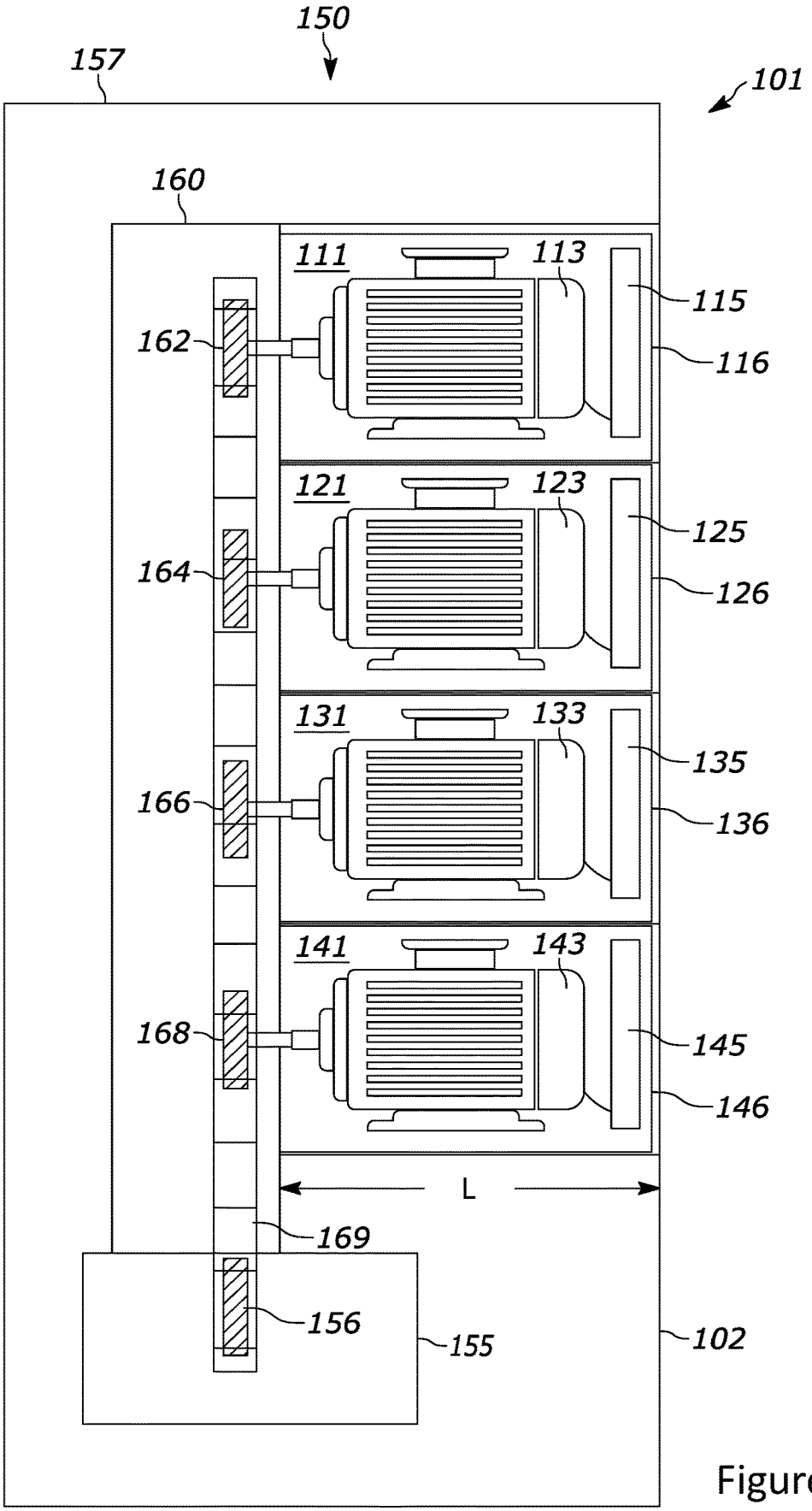
FIG. 1B illustrates another example drive pod system, in accordance with at least one configuration disclosed herein.

With reference to FIG. 1B, another system is disclosed, such as a drive pod system 101. Instead of drive pods including engines, as disclosed within the drive pod system 100, the drive pod system 101 instead includes a first drive pod 111, a second drive pod 121, a third drive pod 131, and a fourth drive pod 141. The first, second, third, and fourth drive pods 111, 121, 131, and 141 instead each include motors, such as first, second, third, and fourth motors 113, 123, 133, and 143 used to power the excavator 150 to which they are coupled. The first, second, third, and fourth drive pods 111, 121, 131, and 141 can each include a battery (e.g., nickel-cadmium, lead acid, lithium ion, etc.), such as first, second, third and fourth batteries 115, 125, 135, and 145, respectively, to power the first, second, third, and fourth motors 113, 123, 133, and 143.

In at least one configuration, the drive pod systems 100 and 101 can use the same first, second, third, and fourth drive pod frames 116, 126, 136, and 146, the same in that they at least have the same coupling points to couple the first, second, third, and fourth drive pod frames 116, 126, 136, and 146 to the excavator frame 157, although these frames can include variations such as couplers for an engine vs. couplers for a motor. Since, the first, second, third, and fourth engines 112, 122, 132, and 142, and the first, second, third, and fourth motors 113, 123, 133, and 143, can be coupled to the first, second, third, and fourth drive pod frames 116, 126, 136, and 146, any of the first, second, third, and fourth drive pods 110, 120, 130, and 140, and the first, second, third, and fourth drive pods 111, 121, 131, and 141, can be used with the excavator 150 at any given time. Thus, the excavator 150 can include use of a combination of engines and motors, any combination of which can be simply coupled to the excavator frame 157 to drive the ground manipulator apparatus 155.

Figure 2:
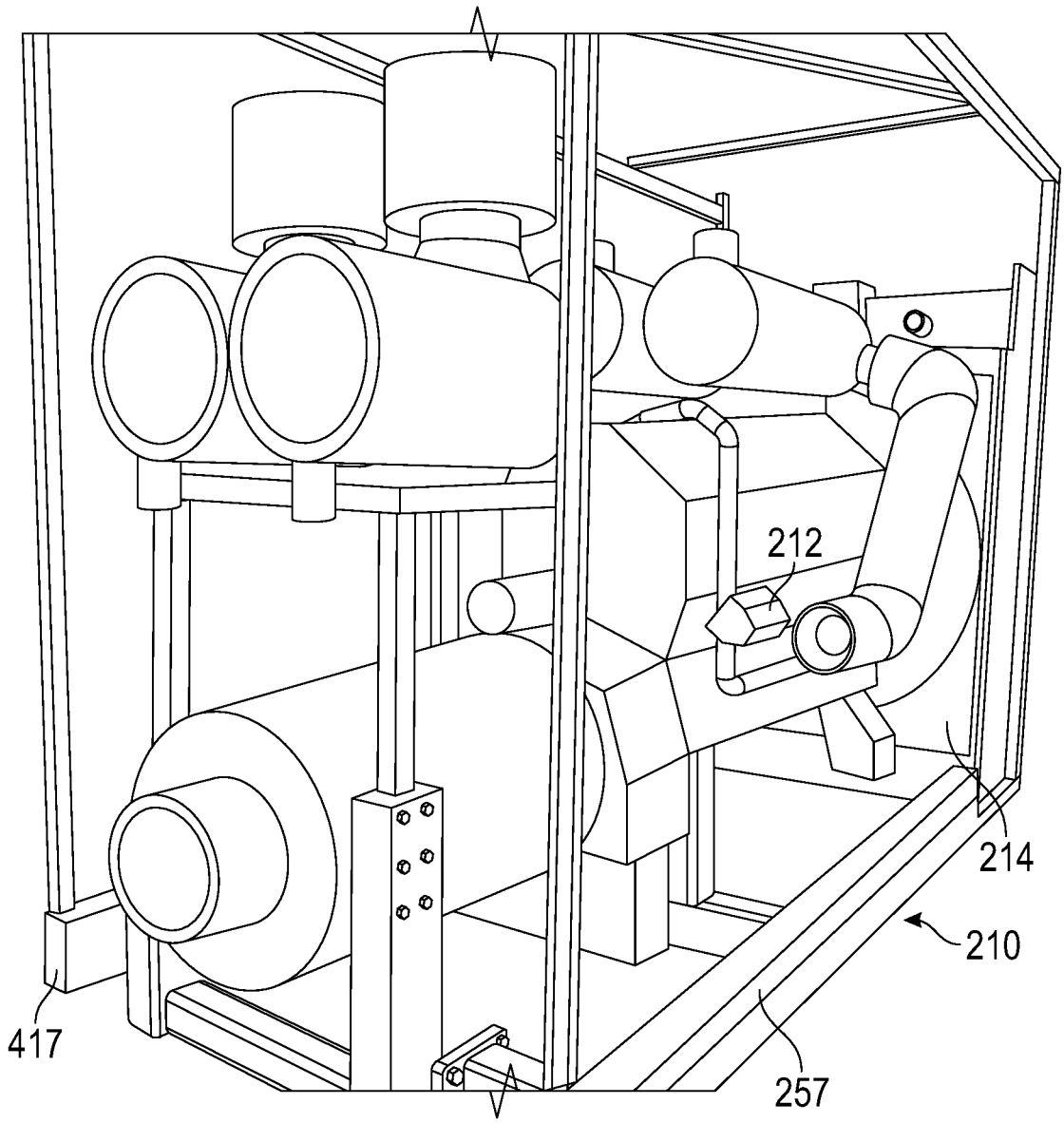
FIG. 2 illustrates an isometric view of an example drive pod, in accordance with at least one configuration disclosed herein.
Figure 3:
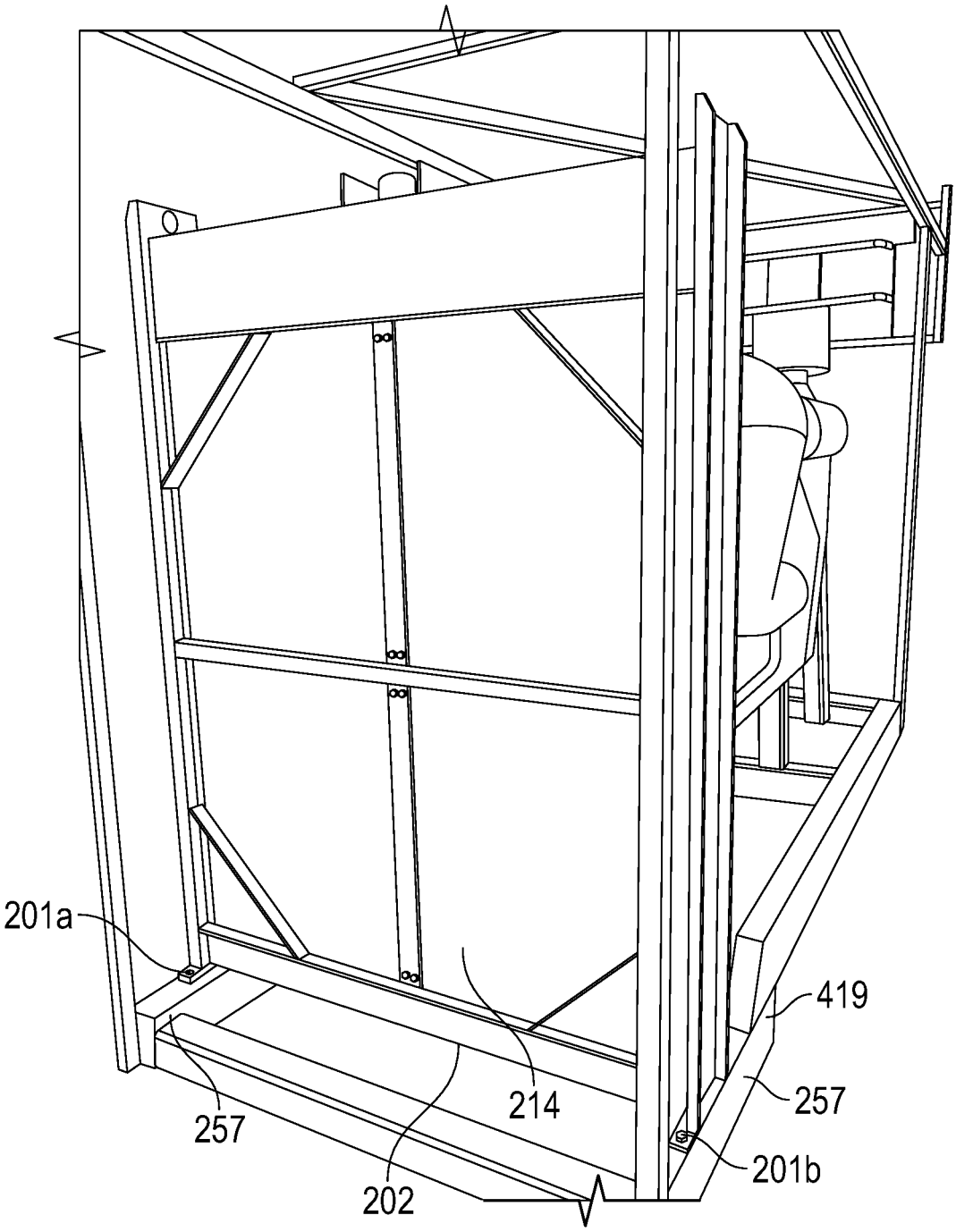
FIG. 3 illustrates another isometric view of the example drive pod shown in FIG. 2, in accordance with at least one configuration disclosed herein.

Now with reference to FIGS. 2 and 3, an example drive pod 210 is illustrated. In this example, the drive pod 210 includes an engine 212 that is a Caterpillar C32 engine that can produce between 600-1,800 horsepower at 2,300 rpm. Thus, using the Caterpillar C32 engine for the first, second, third, and fourth engines 112, 122, 132, and 142 of the drive pod system 100 would result in the excavator 150 having between 2,400-7,200 horsepower. As can be seen in FIGS. 2 and 3, the engine 212 is coupled to a radiator 214, the radiator 214 being further coupled (e.g., bolted) via fasteners 201*a* and 201*b* (e.g., bolts) on opposite sides of a bottom 202 of the radiator 214 to a frame 257 of the drive pod 210. The drive pod 210 shown in FIGS. 2 and 3 is lacking a transmission. This in contrast to the drive pods 410, illustrated in FIGS. 4-6, that further each include transmissions 418 coupled to engines 412, respectively.

Figure 4:
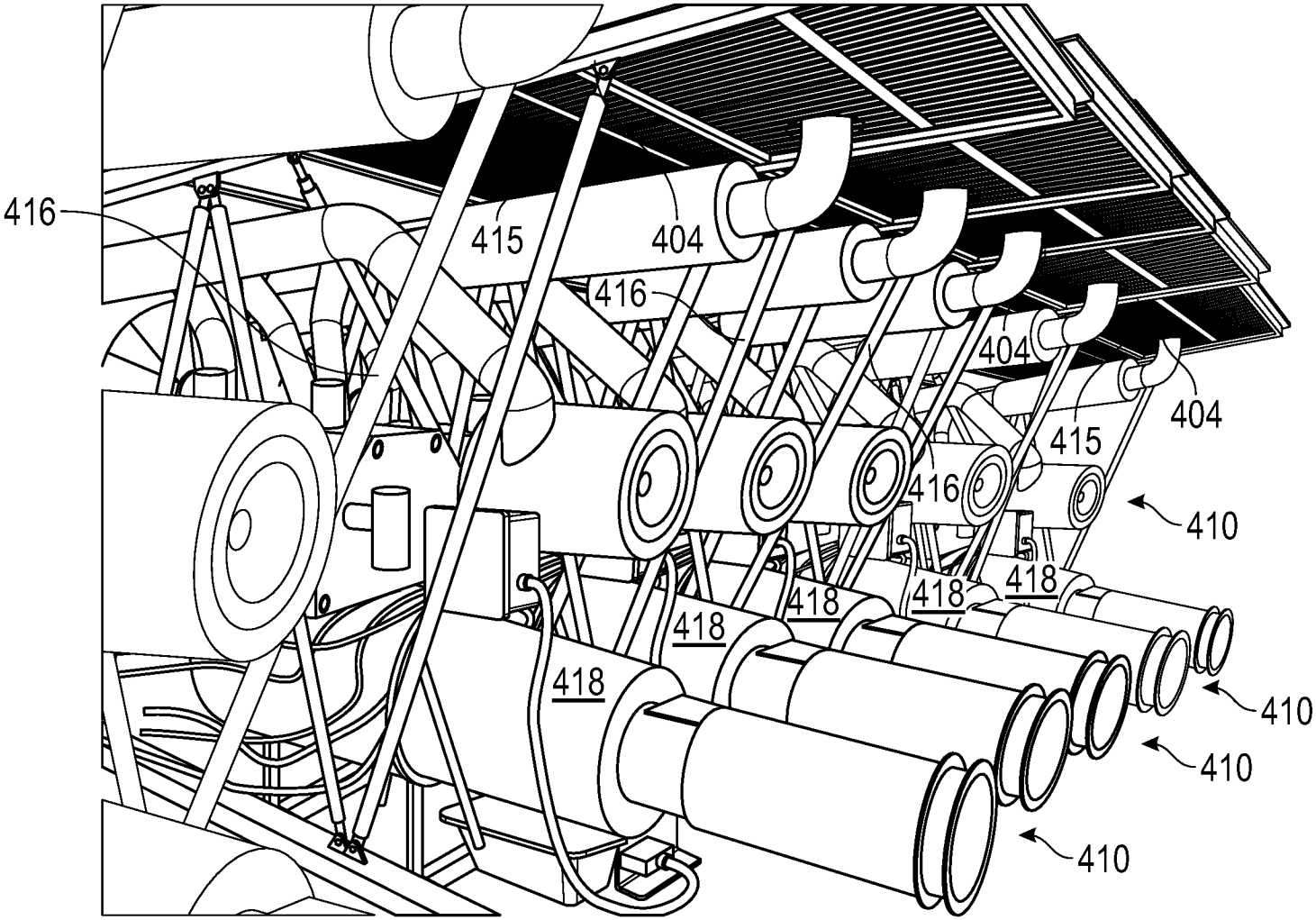
FIG. 4 illustrates an isometric view of a plurality of another example drive pod, in accordance with at least one configuration disclosed herein.
Figure 5:
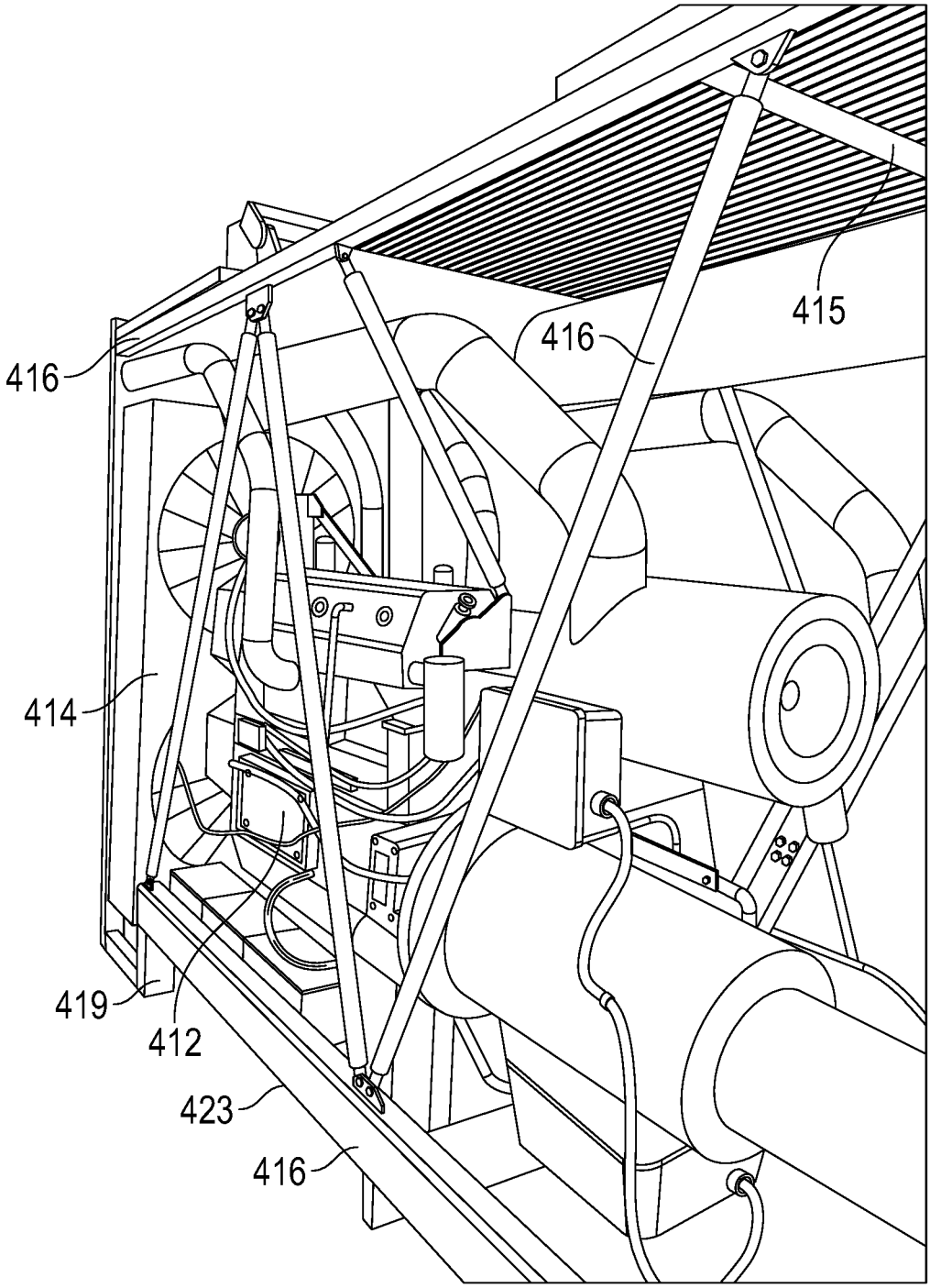
FIG. 5 illustrates another isometric view a single drive pod shown in FIG. 4, in accordance with at least one configuration disclosed herein.
Figure 6:
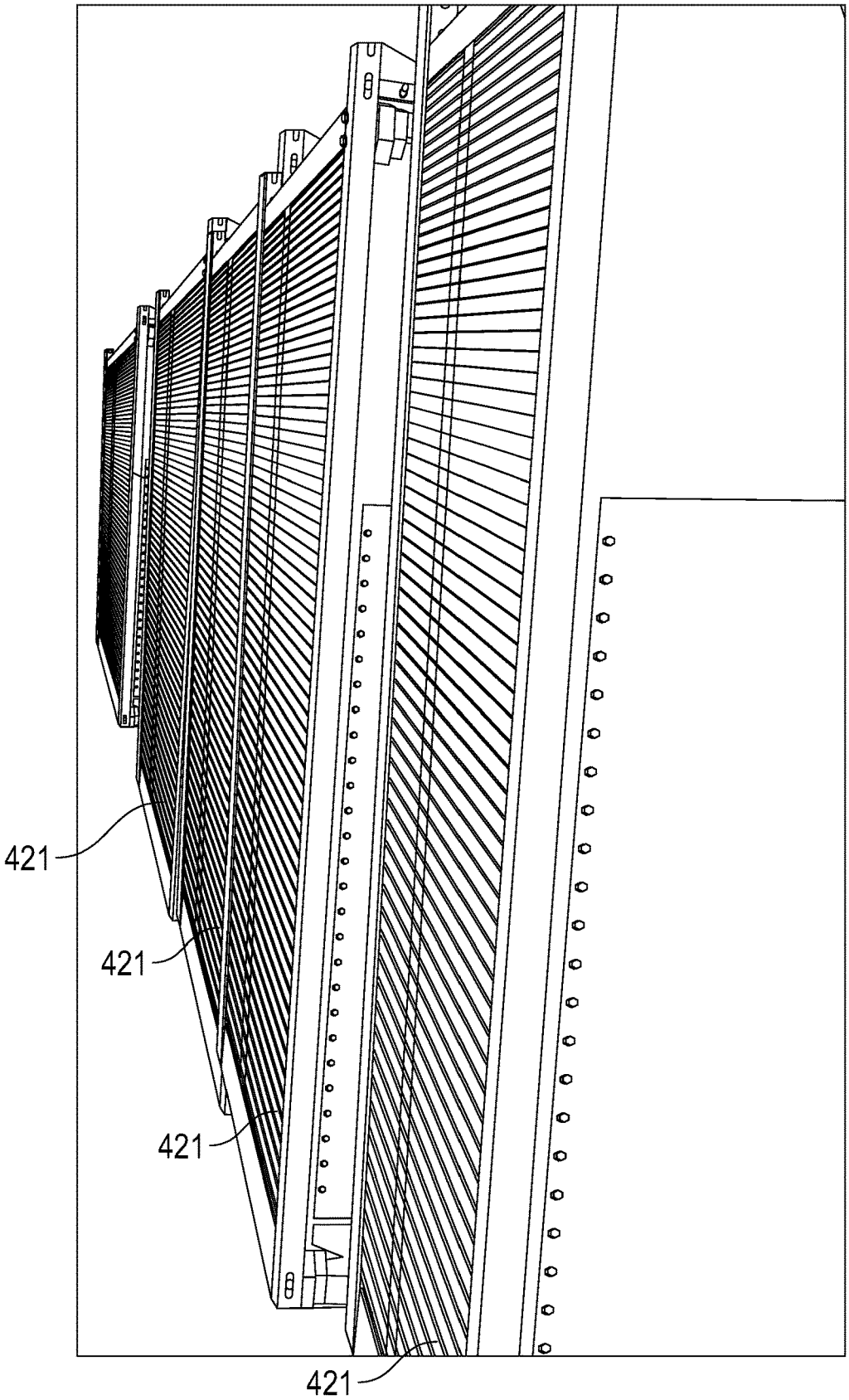
FIG. 6 illustrates another isometric view the plurality of the example drive pod shown in FIG. 4, in accordance with at least one configuration disclosed herein.

Also illustrated in FIGS. 4-6 are grates 415 coupled (e.g., welded) at tops 404 of drive pod frames 416 which can be used as supports for technicians and/or equipment that may be disposed over the engines 412. To provide a hard stop for the drive pod frames 416 when they are being slid into place against a corresponding excavator frame, the drive pod frames 416 further include frame ends 417 (FIGS. 2 and 7) disposed on opposite ends of the drive pod frames 416 from radiators 414, and disposed along a bottom 423 of the frames 416. The drive pod frames 416 can further included a frame step 419 (FIGS. 3, 5, and 7) allow for the user of larger radiators 414 than would be possible without the frame step 419, the frame step 419 increasing a distance between a top of the drive pod 210 to a bottom of the drive pod 210. As radiators are typically relatively delicate equipment, being susceptible to punctures, in at least one configuration radiator guards 421 can be disposed proximate to the radiators 414, respectively, to protect the radiators 414 from puncture on a worksite.

Figure 8:
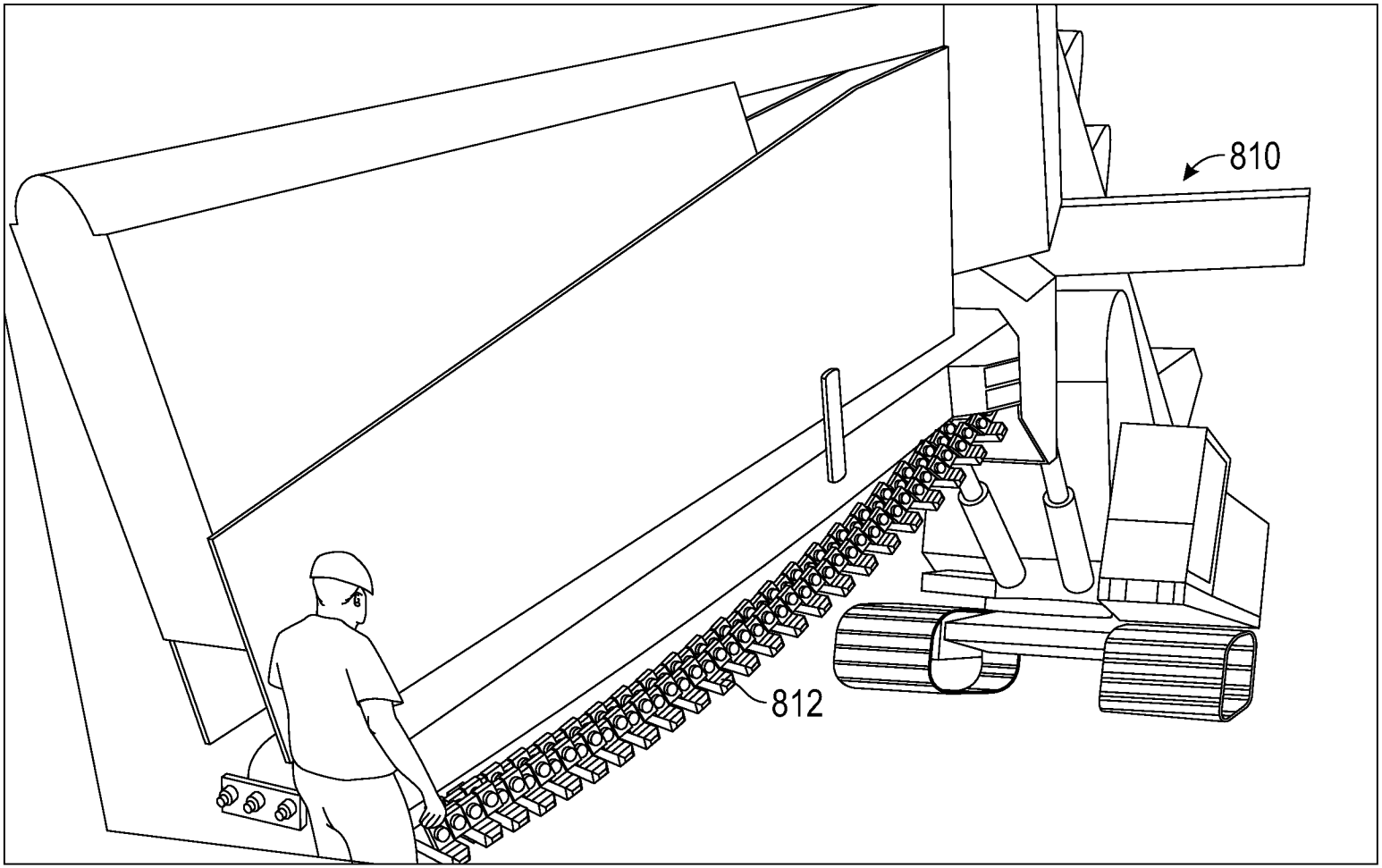
FIG. 8 illustrates an example trencher that can include the drive pod system, in accordance with at least one configuration disclosed herein.

Now with reference to FIG. 8, an example excavator is shown in the form of a trencher 810. The trencher 810 can include the drive pod system 100 describe above to power a ground manipulator apparatus, such as a trencher chain 812. As a length of the trencher chain 812 can be longer or shorter, depending upon a depth of a trench being dug with the trencher chain 812, the trencher 810 can require more or less power to dig the trench. Thus, in accordance with the configuration(s) disclosed herein, the trencher 810 can include more or less drive pods, such as two or more of the first, second, third, and fourth drive pods 110, 120, 130, 140, 210, and 410, depending upon the amount of power needed to dig the trench. The central gearbox 160 transfers power from the first, second, third, and fourth drive pods 110, 120, 130, 140, 210, and 410 to a chain case 815 of the trencher 810, the chain case 815 being coupled to and transferring the power from the first, second, third, and fourth drive pods 110, 120, 130, 140, 210, and 410 to a digging box 820 of the trencher 810.

The foregoing description merely explains and illustrates the disclosure and the disclosure is not limited thereto except insofar as the appended claims are so limited, as those skilled in the art who have the disclosure before them will be able to make modifications without departing from the scope of the disclosure.

What is claimed is:

1. A drive pod system for an excavator, the drive pod system having a plurality of drive pods, wherein the drive pod system comprises:

a first drive pod including a first drive mechanism and a first drive pod frame, the first drive mechanism coupled to the first drive pod frame;

a second drive pod including a second drive mechanism and a second drive pod frame, the second drive mechanism coupled to the second drive pod frame; and a central gearbox to receive power produced by the first drive mechanism and the second drive mechanism and transfer the power to a ground manipulator apparatus of the excavator, the first and second drive pod frames being coupled to an excavator frame of the excavator, wherein each of the plurality of drive pods are structurally configured to be interchangeably coupled to the frame of the excavator and the central gearbox.

2. The drive pod system according to claim 1, wherein the first and second drive mechanisms are at least one of both engines, both motors, and a combination of an engine and a motor.

3. The drive pod system according to claim 1, wherein the first and second drive pods further include a first radiator and a second radiator to cool the first and second drive mechanisms, respectively.

4. The drive pod system according to claim 3, further comprising a first radiator guard and a second radiator guard disposed proximate to the first radiator and the second radiator, respectively, to guard the first radiator and the second radiator.

5. The drive pod system according to claim 1, wherein the first drive pod further includes a first transmission and the second drive pod further includes a second transmission, the first and second transmissions being coupled to drive shafts thereby connecting the first and second drive mechanisms to the central gearbox, respectively.

6. The drive pod system according to claim 1, wherein the excavator is a trencher.

7. The drive pod system according to claim 1, wherein the first and second engines are each a Caterpillar C32 engine.

8. The drive pod system according to claim 1, wherein the excavator further comprises a fuel tank disposed a proximate distance from the first and second drive pods.

9. The drive pod system according to claim 1, wherein the central gearbox includes a first gear coupled to the first drive mechanism and a second gear coupled to the second drive mechanism, and a chain that couples the first gear and the second gear to the ground manipulator apparatus, wherein the first and second drive mechanisms drive the first and second gears, respectively, to transfer power from the first and second drive mechanisms to the central gearbox.

10. The drive pod system according to claim 1, wherein each of the first and second drive pod frames include a grate disposed over the first and second drive mechanism, respectively.

11. The drive pod system according to claim 1, wherein the first and second drive pods are disposed on a same side of the central gearbox.

12. The drive pod system according to claim 1, wherein the first and second drive pods each further include a transmission and a transmission cooler to reduce a temperature of a transmission during use of the excavator.

13. The drive pod system according to claim 12, wherein the first and second transmissions are 8000 series transmissions by Allison Transmission.

14. The drive pod system according to claim 1, wherein the first and second drive pods each further include an intake cooler to reduce a temperature entering the first and second drive mechanisms.

15. The drive pod system according to claim 1, wherein the first and second drive pods further each include a battery coupled to the first and second drive mechanisms, respectively.

16. The drive pod system according to claim 1, further comprising a third drive pod including a third drive mechanism and a third drive pod frame, the third drive mechanism coupled to the third drive pod frame.

17. The drive pod system according to claim 16, further comprising a fourth drive pod including a fourth drive mechanism and a fourth drive pod frame, the fourth drive mechanism coupled to the fourth drive pod frame.

* * * * *